US006726280B1

(12) United States Patent
Liao

(10) Patent No.: US 6,726,280 B1
(45) Date of Patent: Apr. 27, 2004

(54) MECHANISM FOR ADJUSTING THE HEIGHT OF THE BACK SUPPORT OF CHAIR

(76) Inventor: Jih-Shun Liao, P.O. Box 487, Chang-Hua City (TW), 500

( * ) Notice: Subject to any disclaimer, the term of this patent is extended or adjusted under 35 U.S.C. 154(b) by 0 days.

(21) Appl. No.: 10/383,724

(22) Filed: Mar. 10, 2003

(30) Foreign Application Priority Data

Dec. 23, 2002 (TW) ..... 91221071 U

(51) Int. Cl.[7] ..... A47C 7/36; A47C 7/40
(52) U.S. Cl. ..... 297/353; 297/409; 297/410
(58) Field of Search ..... 297/353, 410, 297/409

(56) References Cited

U.S. PATENT DOCUMENTS 4,366,985 A * 1/1983 Leffler ..... 297/409
4,840,429 A * 6/1989 Stockl ..... 297/409
6,270,161 B1 * 8/2001 De Filippo ..... 297/410
6,511,130 B2 * 1/2003 Dinkel et al. ..... 297/410

* cited by examiner

*Primary Examiner*—Anthony D. Barfield

(57) ABSTRACT

A mechanism for adjusting the height of the back support of a chair comprises a frame, a back support, a first link, and a second link. Two lateral plates extend vertically at the top of the frame. A U bracket is mounted on the rear wall of the back support, whose lateral plates have two symmetrically formed pairs of axle holes. At two ends of the first and the second links, there exist holes for respectively pivotably connected to those pairs of axle and pivot holes by axle pins. The lines defined by two pivot holes and two axle holes take special oblique angles, so that when those links rotate about the top Of the frame, the back support keeps vertical. When the links are placed vertically, the back support supports a sitter's back. When the links are placed horizontally, the back support supports a sitter's waist.

5 Claims, 7 Drawing Sheets

MECHANISM FOR ADJUSTING THE HEIGHT OF THE BACK SUPPORT OF CHAIR

FIELD OF THE INVENTION

The present invention relates to a mechanism for adjusting the height of the back support of a chair, and particularly to simultaneously adjusting the height and horizontal position of the back support under the constraint that the back support always stands vertically. According to a sitter's need, the back support can support the sitter's back or waist by adjusting the back support to a suitable height.

BACKGROUND OF THE INVENTION

The conventional mechanism for a height adjustable chair back support is mainly a mechanical structure between a chair seat and a chair back support by which the position of the back support can be changed. The conventional high adjustment mechanism has the following disadvantages. First, the mechanical structure consists of many parts; therefore, the composition of the structure is time-consuming. Secondly, having many parts leads to a structural complexity that makes the coupling of the parts less reliable. Moreover, the conventional mechanism of adjusting height of a back support is realized by rotating a screwed rod by turning a spherical knob fixed at one end and thus driving an axle beam at the other end. Restricted by the diameter of the screwed rod, this process is slow and inconvenient to modern people.

SUMMARY OF THE INVENTION

Accordingly, the primary object of the present invention is to provide a mechanism for adjusting the height of the back support of a chair, which comprises a frame, a back support, a first link, and a second link. The frame has two lateral plates extending vertically at the top thereof, which lateral plates have two pairs of pivot holes formed in corresponding positions. A U bracket is mounted on the rear wall of the back support, whose lateral plates have two symmetrically formed pairs of axle holes. Two ends of the first and the second links are respectively pivotably connected to the U bracket and the frame by using axle pins passing through those pivot and axle holes. While those links are rotating about the top of the frame, the back support always stands vertically. When the links are placed vertically, the back support is in a higher position. When the links are placed horizontally, the back support is in a lower position.

As a further object, the present invention provides a multiple-step positioning of the back support of a chair through allowing a stepwise rotary motion of the first and second links, ranging from zero to ninety degrees. Therefore, a chair with the mechanism is suitable for sitters of various ages.

The various objects and advantages of the present invention will be more readily understood from the following detailed description when read in conjunction with the appended drawing.

DETAILED DESCRIPTION OF THE PREFERRED EMBODIMENTS

Figure 1:
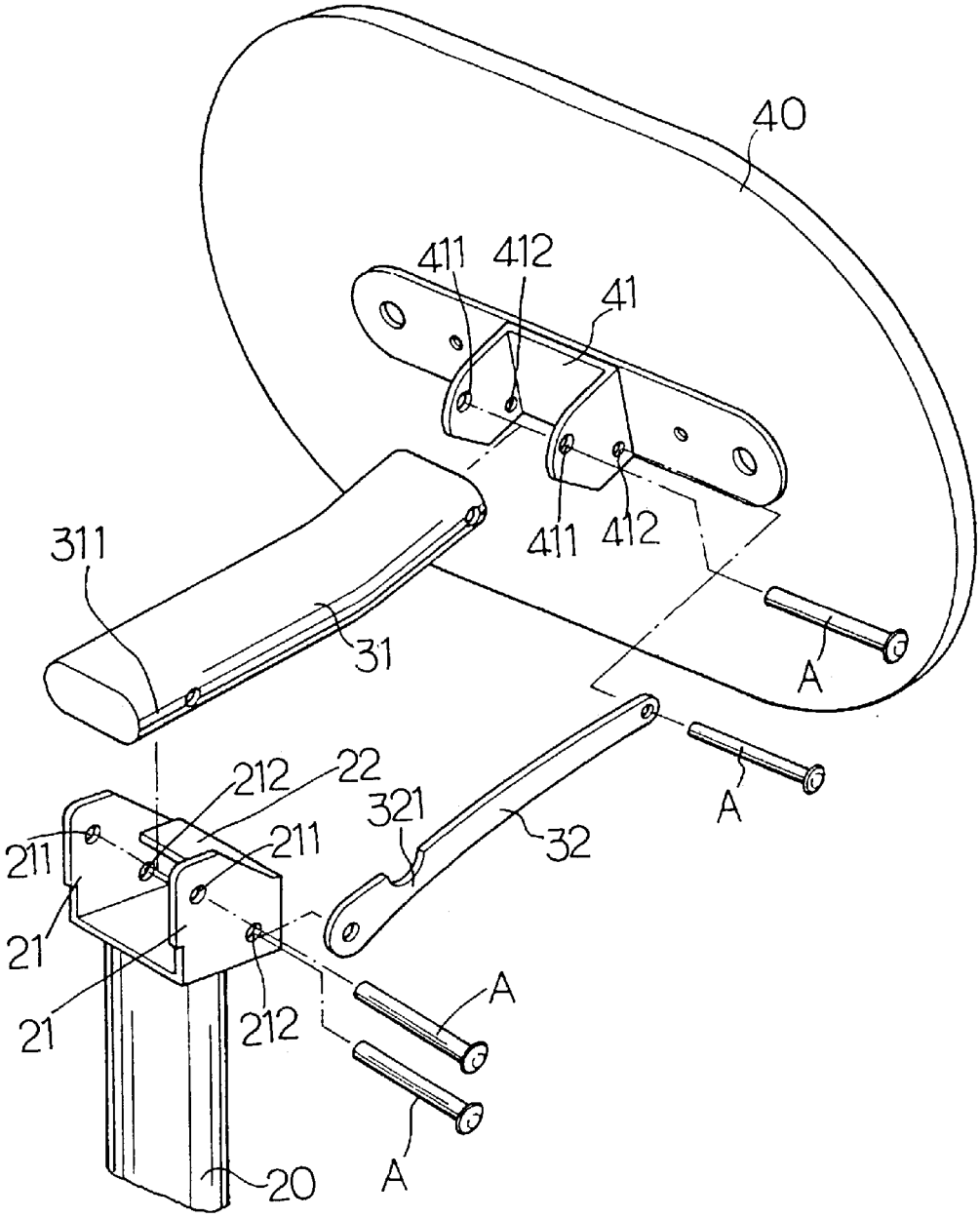
FIG. 1 is an exploded view of the main parts in accordance with the present invention.
Figure 2:
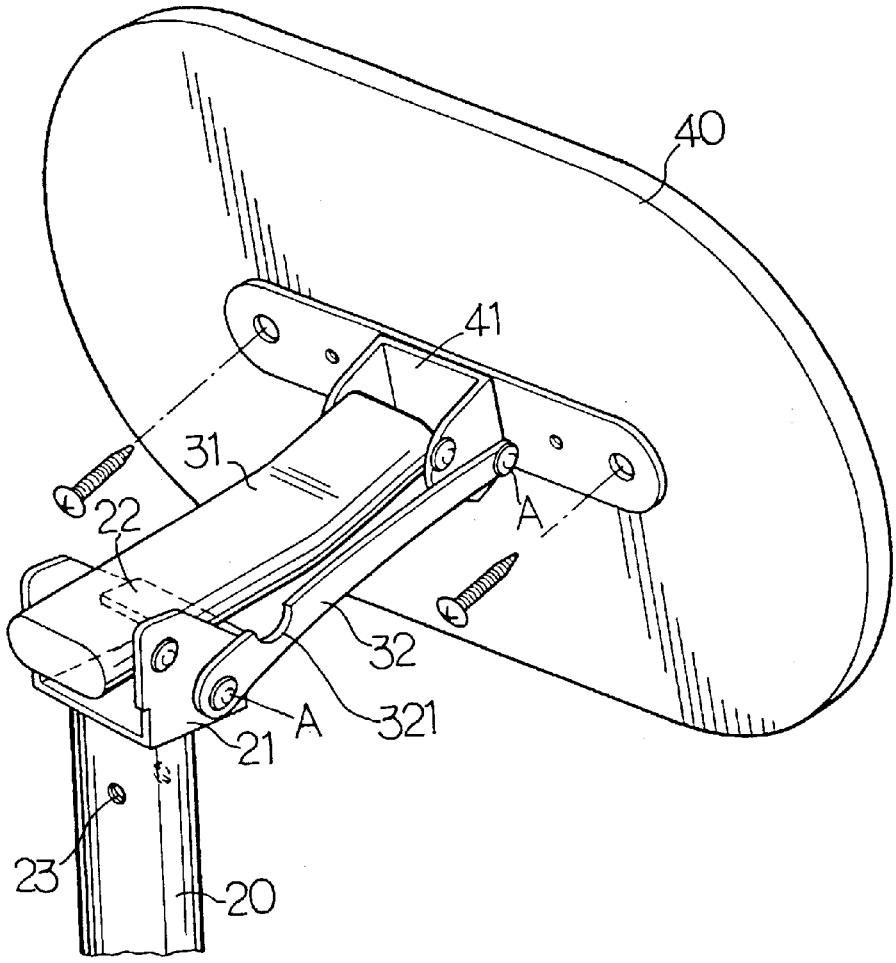
FIG. 2 is a perspective view showing the composition of a height adjustment mechanism in accordance with the present invention.

Referring to FIGS. 1 and 2, the present invention is a mechanism for adjusting the height of a chair back support, which comprises a frame 20, a first link 31, a second link 32, a back support 40, a U bracket 41 that is installed on the rear wall of the back support 40, and a number of axle pins A.

As the mechanism is included in a chair, the bottom of the frame 20 is mounted on the rear end portion at the bottom of the seat of a chair. At the top of the frame 20, there extend vertically two lateral plates 21; a first pivot hole 211 and a second pivot hole 212 are formed on each lateral plate 21 in corresponding positions. The first pivot hole 211 and the second pivot hole 212 are in a diagonal arrangement about 60 degrees from the base on which the lateral plates 21 erect. A support plate 22 is formed between the lateral plates 21 and extends inwardly from the side closer to the second pivot holes 212.

In the upper end portion of the first link 31 that extends toward the back support 40, a hole linking one lateral face of the link to the other is formed. In the lower end portion of the first link 31 that extends toward the frame 20, a hole linking one lateral face of the link to the other is formed. Further, there exists an extended section 311 from the hole in the lower portion beyond the lower hole.

In the upper end portion of the second link 32 that extends toward the back support 40, a hole linking one lateral face of the link to the other is formed. In the lower end portion of the second link 32 that extends toward the frame 20, a hole linking one lateral face of the link to the other is formed. An arced gap 321 is formed on the lower end portion and on the top lateral side of the second link 32.

The U bracket 41 is mounted on the rear wall of the back support 40. A first axle hole 411 and a second axle hole 412 are formed on each lateral side of the U bracket 41 in corresponding positions. The first axle hole 411 and a second axle hole 412 are in a diagonal arrangement about 45 degrees from the bottom edge of the U bracket 41.

According to the components described above, we now describe the composition of the mechanism of the present invention. The upper end portion and the lower end portion of the first link 31 are respectively received within the U bracket 41 and between the lateral plates 21. The upper end of the first link 31 is pivotably connected to the U bracket 41 by inserting an axle pin A through the upper hole and two first axle holes 411 on the U bracket 41. The lower end portion of the first link 31 is pivotably connected to the frame 20 by inserting another axle pin A through the lower hole and two first pivot holes 211 on the lateral plates 21 extending from the frame 20. The second link 32 also connects the U bracket 41 and the frame 20. The upper end of the second link 32 is pivotably connected to outer wall of a lateral side of the U bracket 41 at the second axle hole 412 by an axle pin A; the axle pin A pierces through the upper hole of the second link 32 and two corresponding second axle holes 412 on the U bracket 41. The lower end of the second link 32 is pivotably connected to outer wall of the lateral plate 21 on the same side the link is connected to the U bracket 41; another axle pin A passes through the lower hole of the second link 32 and two corresponding second pivot holes 212 on the lateral plates 21.

Figure 3:
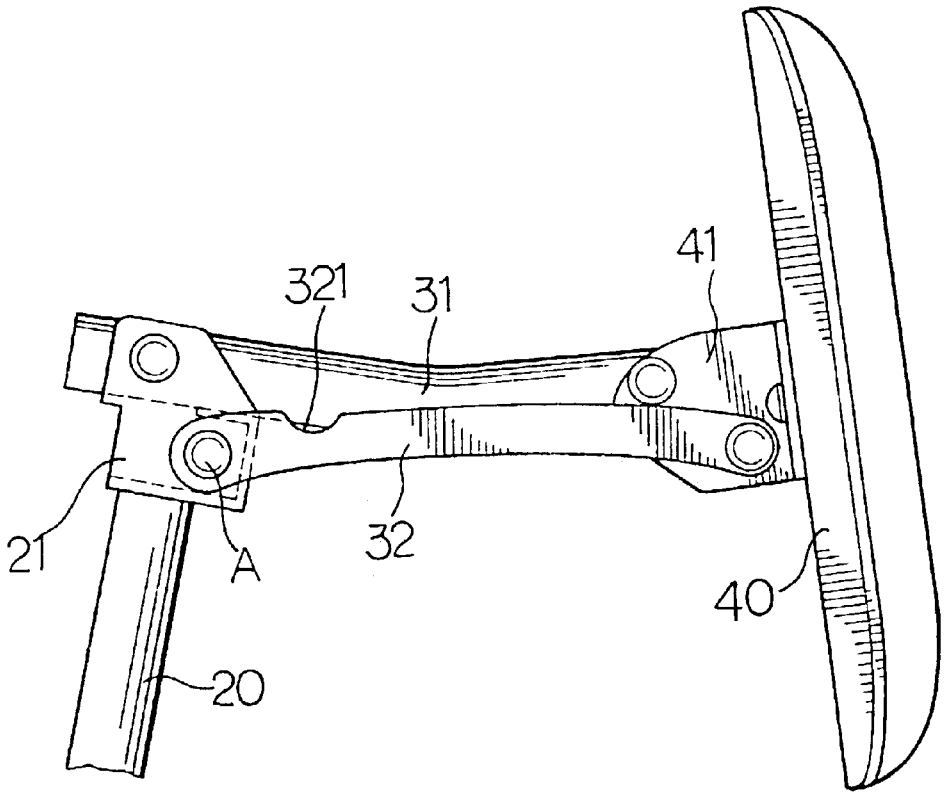
FIG. 3 is a lateral view of showing the composition of a height adjustment mechanism in accordance with the present invention.
Figure 4:
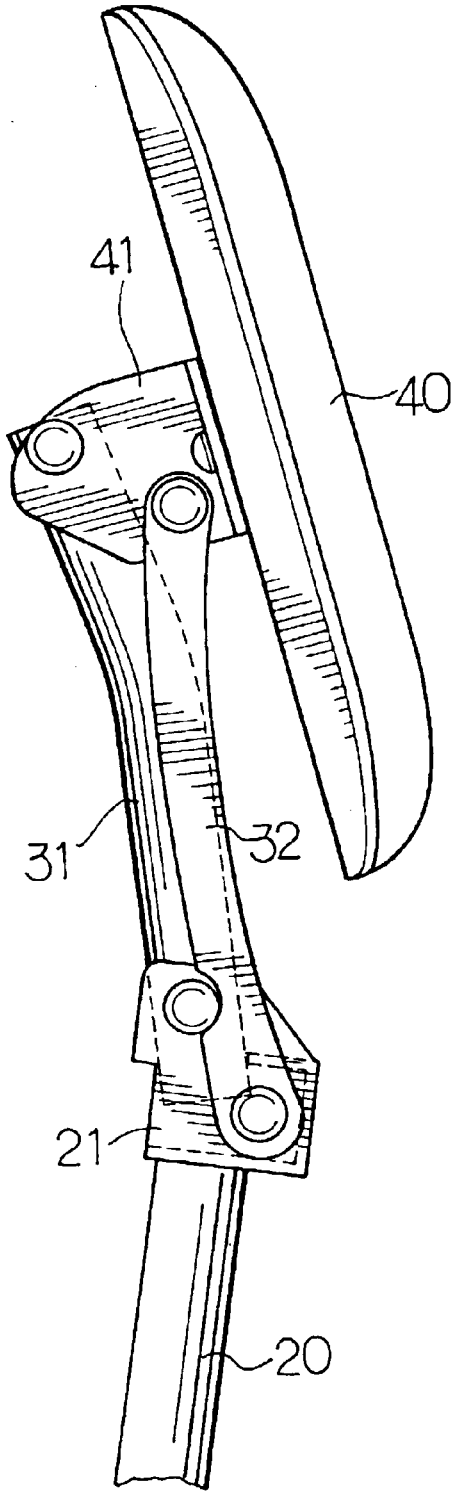
FIG. 4 is a lateral view of showing the composition of an embodiment of the present invention.

According to the above configuration, the position of the back support 40 is adjustable by directly moving the back support 40 so as to rotate the the first link 31 and the second link 32 about the top of the frame 20. As shown in FIG. 3, as the first link 31 and the second link 32 are horizontal, the back support 40 is in a low position. When installed in a chair, the back support 40 can be used to support the waist of an adult sitter or the back of a children sitter. As shown in FIG. 4, as the first link 31 and the second link 32 are vertical, the back support 40 is in a high position. When installed in a chair, the back support 40 can be used to support the back of an adult sitter. In the vertical configuration, the extended section 311 of the first link 31 is blocked by an edge of the support plate 22 between the lateral plates 21, and the axle pin A on the lower end portion of the first link 31 is clipped in the arced gap 321 of the second link 32. Therefore, the first link 31 and the second link 32 can be held firmly in the vertical configuration.

Figure 5:
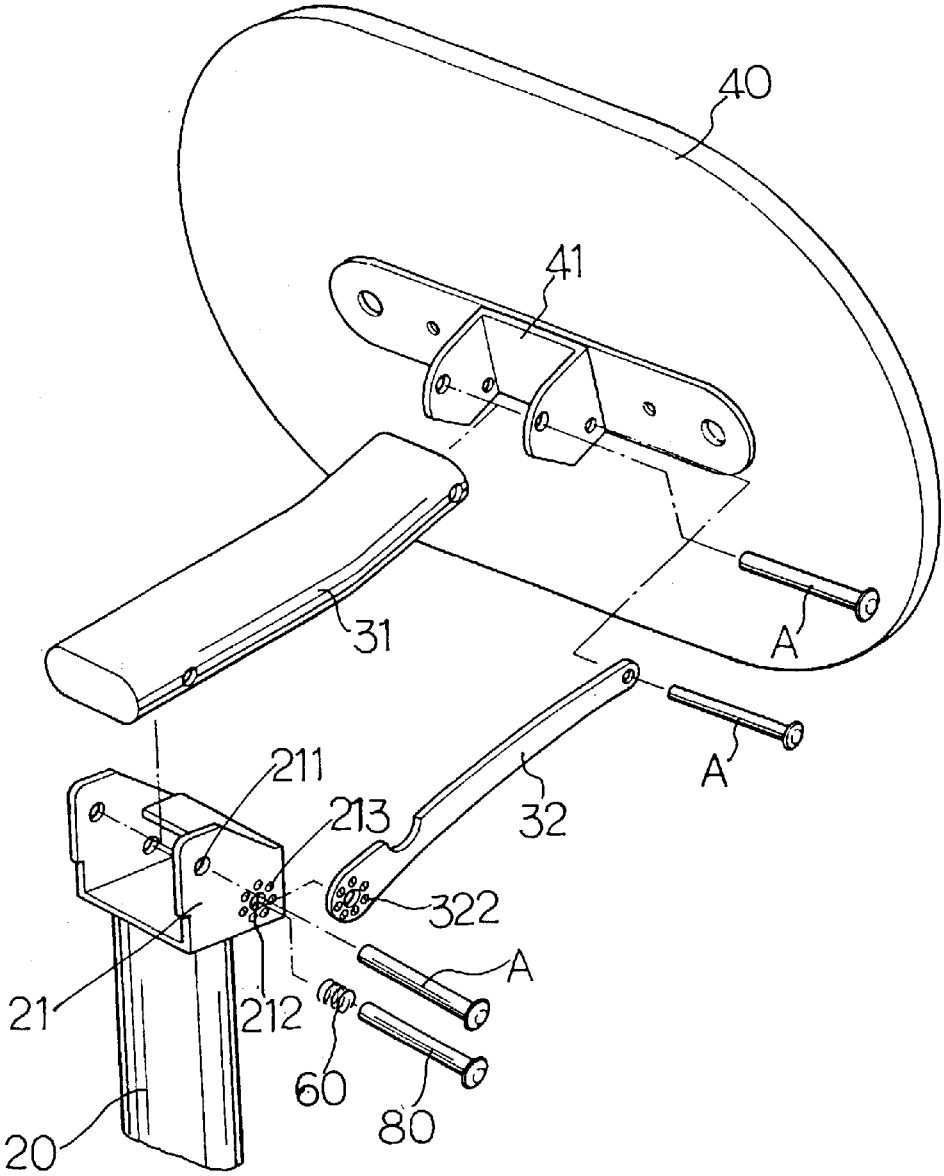
FIG. 5 is an exploded view showing the structure of another embodiment of the present invention.

The above-mention components and their combination is the first embodiment of the present invention of a mechanism for adjusting the height of a chair back support, wherein the height adjustment of the back support is two-step, namely, high position and low position. The second embodiment is a mechanism for adjusting the height of a chair back support, wherein the height adjustment is multiple-step. As shown in FIG. 5, around the hole on the lower end portion of the second link 32 facing the lateral plate 21, there are a number of bulged points 322 formed in a circular arrangement. On the face of the lateral plate 21 in contact with the second link 32 and around the second pivot hole 212 thereof, there are a number of round notches 213 formed in a corresponding circular arrangement. The round notches 213 and the bulged points 322 are formed in corresponding positions and can thus fit into each other when brought together. Further, a pin with a screwed tip 80 and a spring 60 slipped thereon, instead of an axle pins A, is used to connect the second link 32 and the frame 20 by inserting the pin from the hole on the second link 32 through the right lateral plate 21 to the left lateral plate 21. The pin with a screwed tip 80 is then turned tight to assure the bulged points 322 lodging in the round notches 213. To achieve a change in the angular position of the links 31 and 32, the pin with a screwed tip 80 is turned loose in the first place, and then the first link 31 and the second link 32 are driven to rotate. In this process, the bulged points 322 are driven out of the round notches 213, causing an effect of pressing the spring 60 at the same time. As long as rotation of the links causes the bulged points to meet the round notches 213 again, the restoring force of the spring 60 presses the bulged points 322 into the round notches 213 to form a locked state. The rotation continues till the back support 40 attains the angular position we want to adjust to. The pin with a screwed tip 80 is then turned tight again to assure that the second link 32 will not slip.

Figure 6:
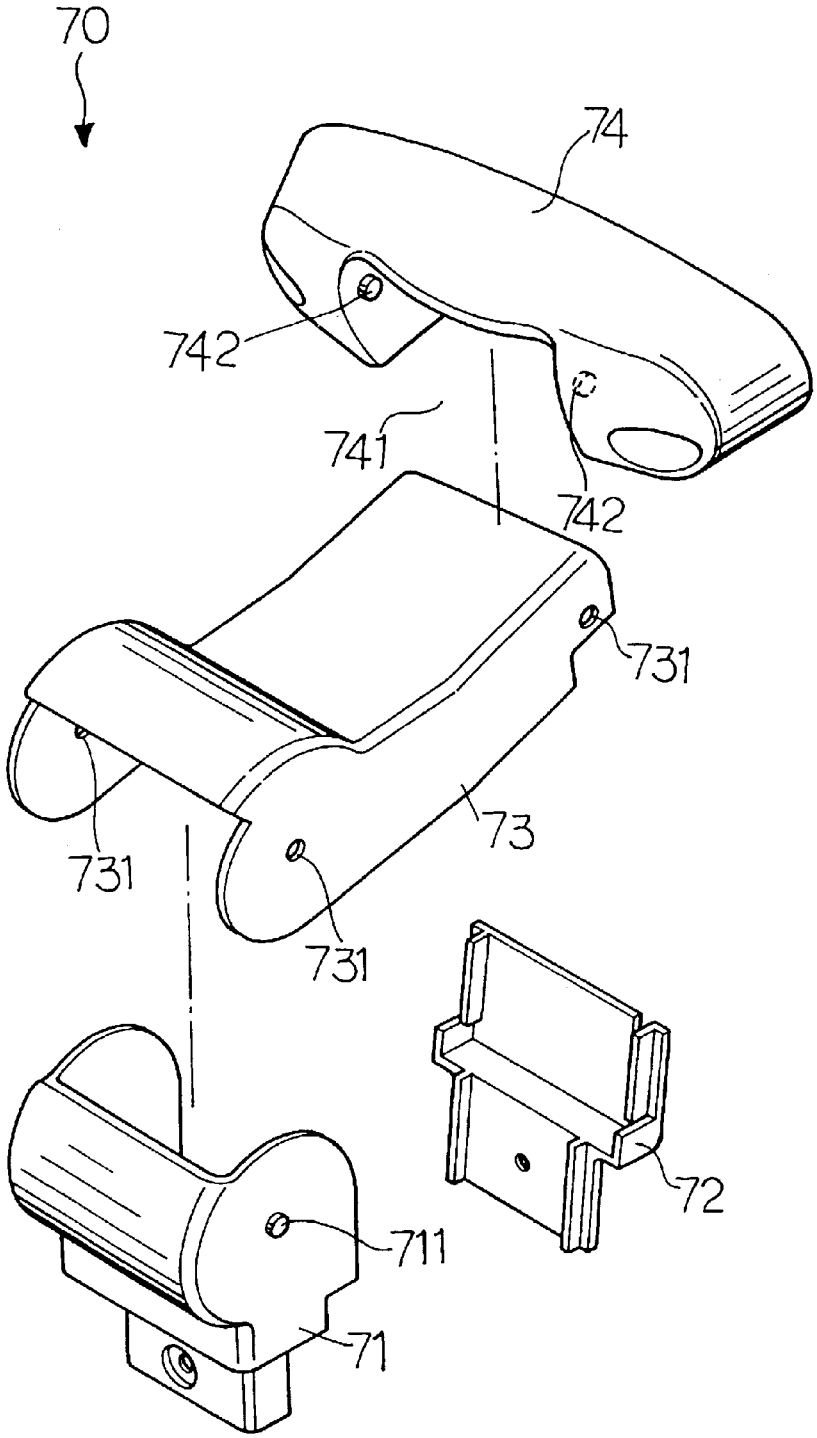
FIG. 6 is an exploded view of the main parts of a dust cover associated with the present invention.
Figure 7:
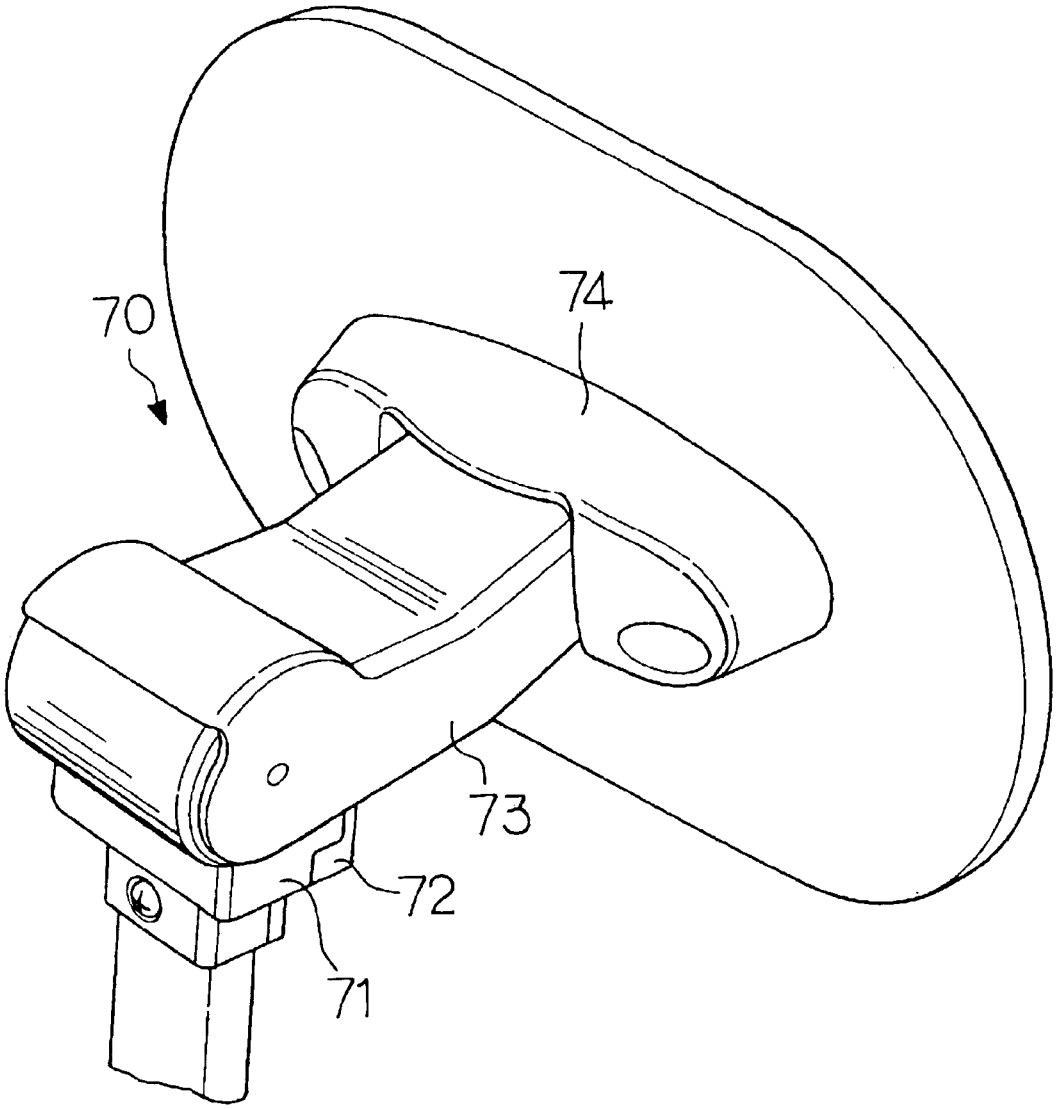
FIG. 7 is a perspective view showing the composition of a dust cover associated with the present invention.

It is a further embodiment of the present invention of a mechanism for adjusting the height of a chair back support that a dust cover 70 is installed to protect the components of the height adjusting mechanism from dust invasion; the dust cover 70 also enhances the outlook of the mechanism. To incorporate the dust cover 70, two tap holes 23 are formed in corresponding positions on two sides of the frame 20 close to the lateral plates 21, as shown in FIG. 2. As shown in FIG. 6 and FIG. 7, the dust cover 70 comprises a front bracket cover 71, a rear bracket cover 72, a link cover 73, and a U bracket cover 74. The front bracket cover 71 and the rear bracket cover 72 are respectively installed on the front and rear sides of the frame 20, by getting screwed at the tap holes 23, so as to form a cover that hides the pivoting section where the lateral plates 21 and the first and second links 31, 32 connect. Two bulged pins 711 are formed symmetrically on two lateral faces in the upper part of the front bracket cover 71. Two holes 731 are formed on two lateral sides in the rear part of the link cover 73; the holes 731 are in corresponding positions to the bulged pins 711, so that the link cover 73 can be incorporated on the front bracket cover 71 at the bulged pins 711, and the places two covers connected are pivotably movable. The U bracket cover 74 is for covering the U bracket 41 on the rear wall of the back support 40. A recess 741 is formed in the middle portion of the U bracket cover 74 for receiving the front portion of the link cover 73. Two bulges pins 742 are formed symmetrically on two lateral inner walls of the recess 741. Two other holes 731 are formed symmetrically on two lateral outer walls in the front part of the link cover 73. The bulges pins 742 and the front holes 731 are in corresponding positions that two cover can be connected by inserting the pins into the holes; the place of connection is pivotably movable. The dust cover 70 thus constituted moves with the components as an adjustment of back support 40 is in process.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A mechanism for adjusting the height of the back support of a chair comprising:

a frame being mounted on a rear portion at a bottom of a chair seat, a back support, a first link pivotably connecting to said frame at a top thereof and a rear wall of said back support, and a second link pivotably connecting to said frame at a top thereof and said rear wall of said back support, said second link being in parallel to said first link;

a lower pivotal point at which an end of said first link and said frame connect and a lower pivotal point at which an end of said second link and said frame connect being arranged in a way that a line defined by said lower pivotal points is oblique to the horizontal direction at a definite angle, an upper pivotal point at which the other end of said first link and said rear wall of said back support connect and an upper pivotal point at which the other end of said second link and said rear wall of said back support connect being arranged in a way that a line defined by said upper pivotal points maintains a constant oblique angle to the horizontal direction during a process of changing said back support's height; said back support therefore being held vertical during said process.

2. The mechanism for adjusting the height of the back support of a chair of claim 1, wherein two lateral plates extend vertically at an top of said frame, and a first pivot hole and a second pivot hole are formed on each said lateral plate, said pivot holes on two said lateral plates being in corresponding positions, said first link and said second link having holes formed on an upper end portion and a lower end portion thereof, a U bracket being mounted on a rear wall of said back support; a first axle hole and a second axle hole being formed on each lateral plates of said U bracket; said axle holes on two said lateral plates being in corresponding positions; and said upper end portion and said lower end portion of said first link respectively being pivotably connected within said U bracket and between said lateral plates of said frame by two axle pins; one said axle pin passing through said first axle holes and another said axle pin passing through said first pivot holes; said upper end portion and said lower end portion of said second link respectively being pivotably connected on one said lateral plate of said U bracket and on one said lateral plate of said frame by two other axle pins; one said other axle pin passing through said second axle holes and another said other axle pin passing through said second pivot holes.

3. The mechanism for adjusting the height of the back support of a chair of claim 2, wherein a support plate between said lateral plates of said frame and close to said second pivot holes is formed extends inwardly, said support plate supporting said lower portion of said first link as said first link is placed horizontally.

4. The mechanism for adjusting the height of the back support of a chair of claim 2, wherein an extended section is formed on said lower end potion of said first link beyond said lower hole thereon, said extended section being blocked, by an edge of said support plate to stabilize said first link as said first link is placed vertically.

5. The mechanism for adjusting the height of the back support of a chair of claim 2, wherein, on the lateral plate in contact with said second link and around said second pivot hole, a number of round notches are formed and arranged circularly in equal angular divisions and, on an inner face of said lower end portion of said second link and around said lower hole thereon, a number of bulged points are formed and arranged circularly in positions corresponding to said round notches; a pin with a screwed tip and a spring slipped on passing through said lower hole of said second link and said second pivot holes of said frame, said pin being turned tight to effect the positioning of said first link and second link in a multiple-step height adjustment, said spring inhabiting between said second link and the unscrewed end of said pin for assuring close contact between said round notches and said bulged points.

* * * * *